US005269332A

United States Patent [19]

Osborne

[11] Patent Number: 5,269,332

[45] Date of Patent: Dec. 14, 1993

[54] RETRACTABLE PROTECTIVE COVERING

[76] Inventor: John M. Osborne, 6224 Del Norte La., Dallas, Tex. 75225

[21] Appl. No.: 953,463

[22] Filed: Sep. 29, 1992

[51] Int. Cl.[5] ..... E04H 15/06

[52] U.S. Cl. ..... 135/88; 114/361

[58] Field of Search ..... 135/90, 88; 296/136; 114/361

[56] References Cited

U.S. PATENT DOCUMENTS

| | | | |
|---|---|---|---|
| 3,333,594 | 8/1967 | Moss | 135/88 |
| 4,019,212 | 4/1977 | Downer | 9/1.5 |
| 4,228,622 | 10/1980 | Tisma | 52/3 |
| 4,487,212 | 12/1984 | Moore | 135/90 |
| 4,817,654 | 4/1989 | Christensen | 135/90 |
| 4,830,427 | 5/1989 | Fiocchi | 135/90 X |
| 4,848,386 | 7/1989 | Cooper | 135/90 |
| 4,886,083 | 12/1989 | Gamache | 135/88 |
| 4,971,384 | 11/1990 | Baldwin | 296/98 |
| 4,991,612 | 2/1991 | Kiss et al. | 135/88 |
| 5,013,079 | 5/1991 | Ho | 296/136 |
| 5,086,799 | 2/1992 | Lumbleau | 135/90 |

*Primary Examiner*—Carl D. Friedman
*Assistant Examiner*—Creighton Smith
*Attorney, Agent, or Firm*—Dennis T. Griggs

[57] ABSTRACT

A tubular storage container is adapted for storage and deployment a flexible protective sheet for covering an object. The protective sheet is stowed within an inner chamber of the storage container in a collapsed state. The stowed protective sheet is deployed through an open end of the storage container. An attachment bracket mounted on one end of the storage container secures the storage container to a selected supporting base. A supporting line is connected to the sheet for retracting the sheet from the deployed position and pulling the sheet into the inner chamber of the storage container for storage.

25 Claims, 6 Drawing Sheets

RETRACTABLE PROTECTIVE COVERING

FIELD OF THE INVENTION

This invention relates generally to deployable protective covers, and in particular to a storage assembly for housing a protective covering in a stowed position where it is ready for selective deployment about an object to be protected.

BACKGROUND OF THE INVENTION

Owners and operators of automobiles, boats and other vehicles often prefer to cover the vehicle to prevent damage to the vehicle while the vehicle is not being used. Such damage can be caused by fading of the paint and interior from exposure to direct sunlight or inclement weather such as heavy rain, snow, dust, hail or the like.

A conventional garage for the storage of a vehicle provides good protection, but space within the garage may not be available for a extra car or boat. A conventional carport provides some overhead rain and sunlight protection, but leaves most of the vehicle exposed to weather, dust, insects and the like.

DESCRIPTION OF THE PRIOR ART

Conventional vehicle covers usable for both vehicles and boats are adapted to be suspended from a stationary or fixed structural support such as a carport or garage. Some conventional vehicle covering systems are intended to be stored in the vehicle. Vehicle covers that are suspended from the roof or wall of a building are bulky and require a large amount of space when the cover is not in use. Typically, such attached or suspended protective coverings either do not collapse the covering into a comparatively small volume or include massive frames to support the deployed covering. Also, such conventional protective covering systems do not provide convenient storage for the covering when it is not being used.

Accordingly, the need exists for an improved vehicle covering system in which the cover occupies a smaller space when the cover is not being utilized and is being stowed. Also, there is a need for an improved dispensing system for protective covering that protects the covering itself when it is not being used to shield the vehicle.

SUMMARY OF THE INVENTION

The present invention provides an improved deployable protective covering system for shielding an object such as a vehicle or a boat. It overcomes the foregoing size and space limitations of the protective cover when the cover is not being utilized by storing the folded or collapsed flexible protective cover in a bore of an elongated storage tube. The storage tube has a first open end through which a protective cover is deployed and retracted and a second open end through which a support line extends. Typically, the first open end of the storage tube is formed having an L shape with the opening to the bore directed essentially downward toward the object to be protected. The second open end of the storage tube is similarly formed and is oriented in a direction to accommodate extension and retraction of the support line. The support line is connected to the protective covering for pulling the covering from its deployed position into the bore of the storage tube. The support line is attached to the protective covering at a first end and has a second end for pulling the protective covering into the stowed position within the bore of the storage tube.

When the protective covering is in its deployed state, the support line extends through the bore of the storage tube. The storage tube is preferably movably mounted to a supporting structure such as the side of a building or garage. The movable attachment of the storage tube to the building structure permits the movement of the storage tube to a covering position where the first open end is directly above the object to be protected for deployment of the protective covering. Preferably, a winch is coupled to the support line for retracting the protective sheet from its deployed state into the collapsed or stowed state within the bore.

Operational features and advantages of the present invention will be appreciated by those skilled in the art upon reading the detailed description which follows with reference to the attached drawings, wherein:

BRIEF DESCRIPTION OF THE DRAWINGS

FIG. 3 is a cross-sectional view of the storage tube showing the protective covering in a deployed position;

DETAILED DESCRIPTION OF THE PREFERRED EMBODIMENT

Figure 1:
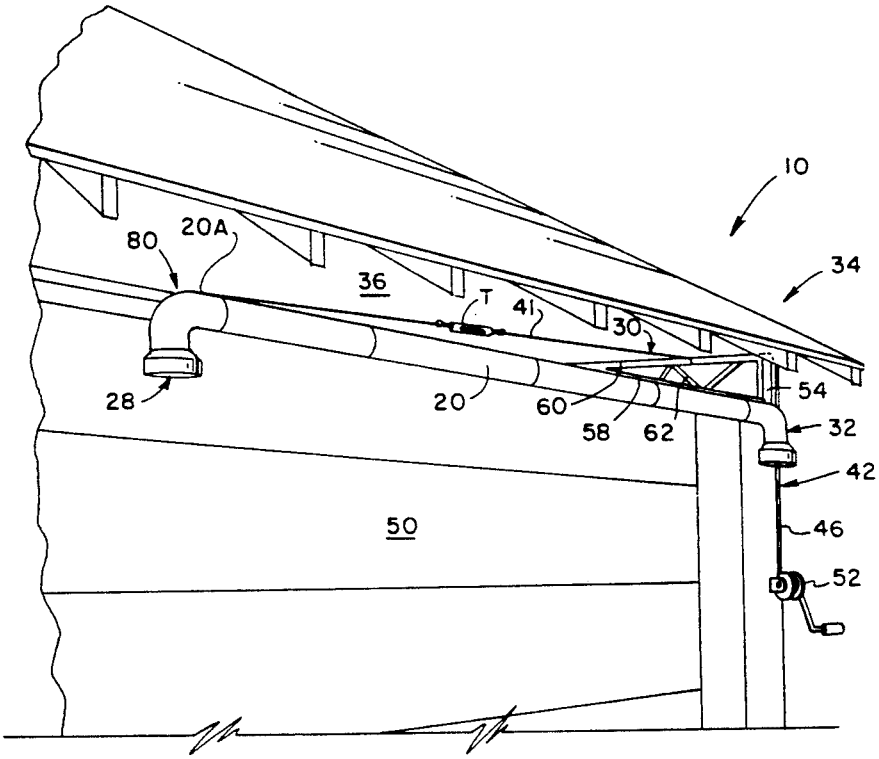
FIG. 1 is a perspective view of a deployable protective covering system having a storage tube mounted on the side of a garage.

In the description which follows, like parts are marked throughout the specification and drawings with the same reference numerals, respectively. The drawing figures are not necessarily to scale and the proportions of certain parts have been exaggerated for purposes of clarity.

Figure 6:
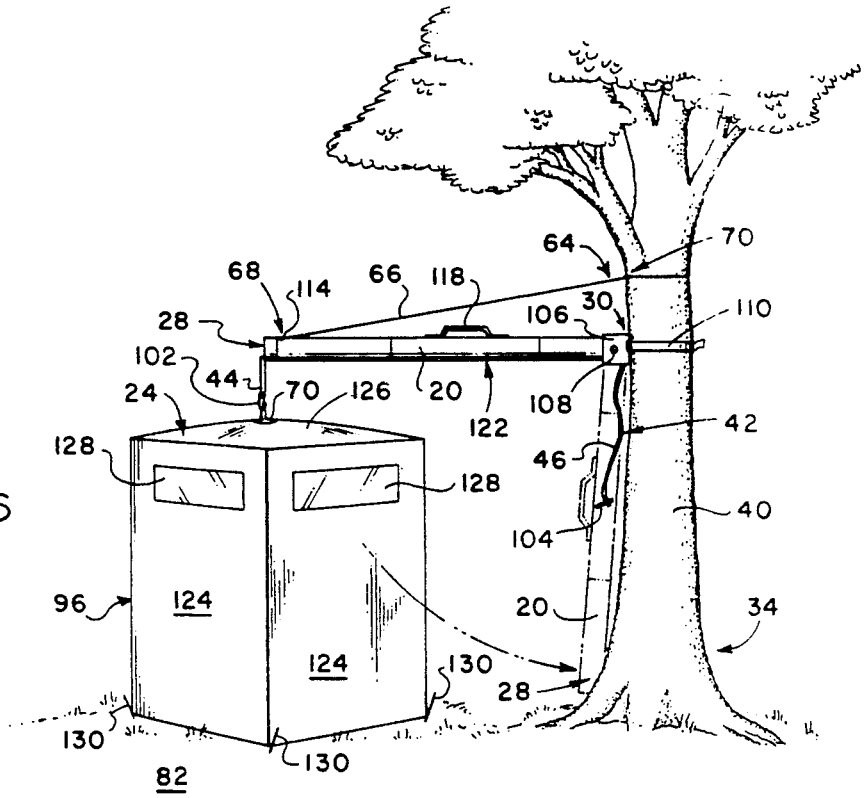
FIG. 6 is a side view of a portable storage tube embodiment for a tent shelter.

Referring now to the drawings, a covering system 10 of the type for protecting an automobile or boat has an elongated storage container 20 with an inner chamber 22 that receives a collapsed, flexible protective sheet 24 having longitudinal folds 26. The storage container 20 has an open end 28 through which the collapsed protective sheet 24 is retracted into the inner chamber 22. A cantilevered support frame 30 mounts the storage container 20 to a desired supporting base 34, such as a wall 36 (FIG. 1), pole 38 (FIG. 9) or tree 40 (FIG. 6). The storage container 20 is supported by a cable 41 which extends from the support frame 30 the distal end 20A.

A support line 42 is connected at a first end 44 to the protective sheet 24 and extends through the inner chamber 22 of the storage container 20. Pulling the opposite end 46 of the support line 42 withdraws the sheet from its deployed position 48 into the folded state 26 for storage in the inner chamber 22 of the storage container 20.

The volumetric capacity of the storage container should be at least as large as the total volume of the collapsed, longitudinally folded protective sheet. Typically, the storage tube 20 is an assembly of multiple plastic or PVC pipe segments. Accordingly, the elongated storage container 20 acts not only to protect the sheet 24, but also to keep the sheet 24 in a compact, unwrinkled condition when the sheet is stowed. The elongated storage container 20 further permits the rapid deployment or dispensing of the stowed protective sheet as desired to protect an automobile or boat.

Figure 4:
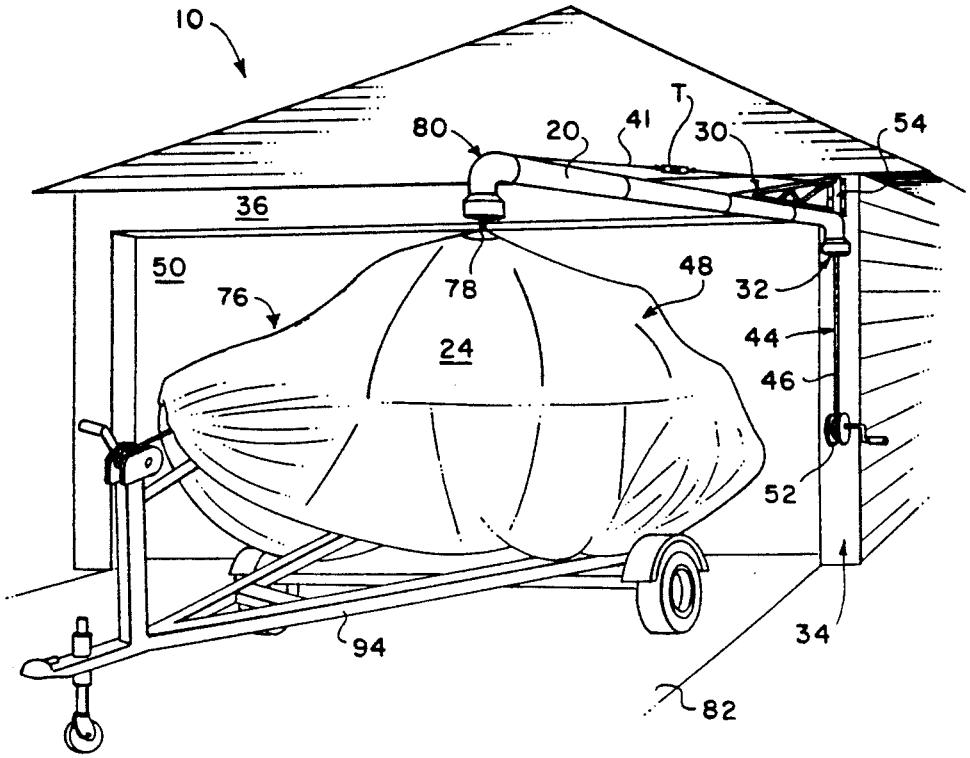
FIG. 4 is a perspective view of the components shown in FIG. 1 with the protective covering shielding a boat on a trailer.

Referring now to FIG. 1 and FIG. 4, the elongated storage container or tube 20 extends from a support structure such as a wall 36 of a building, house or garage. The protective assembly is attached to an exterior wall 36 of a garage typical for the storage of a vehicle such as an automobile. Preferably, the storage container is mounted in proximity to the main vehicular entrance 50 into the garage.

The supporting line or cable 42 has sufficient strength to support and retract the sheet 24. The support line 42 has a first end 44 connected to the protective sheet 24 and a second end 46 for pulling the protective sheet 24 into the bore 22 of the storage tube 20. Preferably, the second end 46 of the support line 42 is attached to a motorized or manual winch 52, a set of pulleys and clamps, or other type of motive means to assist the operator in pulling the line 42 and withdrawing the protective sheet 24 into the storage container 20.

The attachment member 30 extends between the storage tube 20 and the supporting base 34 to mount the storage container 20 to the selected location. Optionally, the attachment means 30 includes a pivotal joint 54 permitting the swinging of the open end 28 of the storage tube 20 about a desired pivotal axis 56. The operator is thus able to move the open end 28 of the storage container 20 to the desired location above the object to be protected for dispensing or deployment of the protective cover 24 and to swing the storage container 20 out of the way when not in use.

Typically, the attachment member 30 consists of a cantilevered truss having a lower beam 58 attached in parallel to the support tube 20 and an upper beam 60 mounted at an angle to the storage tube. Cross braces 62 extend between the lower 58 and upper beams 60 for additional bracing of the attachment member 30. The upper and lower beams 60, 58, respectively, are secured preferably to a pivot joint 54 that has a pivotal axis 56 parallel to the supporting surface 34 and spaced apart from the supporting surface 34. The pivot joint 54 or, optionally, the upper and lower beams 60, 58 are affixed to the supporting surface or structure 34 to mount the storage container 20. If the optional pivot joint 54 is used, the placement of the pivot 54 should be such that the storage container 20 is free to swing about the pivot axis 56 to move the storage tube 20 into and out of the desired position.

Optionally, a secondary supporting member 64 extends from the storage tube 20 near its first end 28 to the supporting base 34 or attachment member 30. Typically such secondary attachment means 64 is a cable 66 extending between two attachment points 68 and 70 with a turnbuckle 72 to properly tension the cable 66. (See FIGS. 6, 9 and 10.)

The storage container 20 should be mounted to its supporting base 34 at a height above or higher than the object to be protected. In this way the storage tube 20 can be freely swung into position above the vehicle 74, boat 76, or other object.

Figure 2:
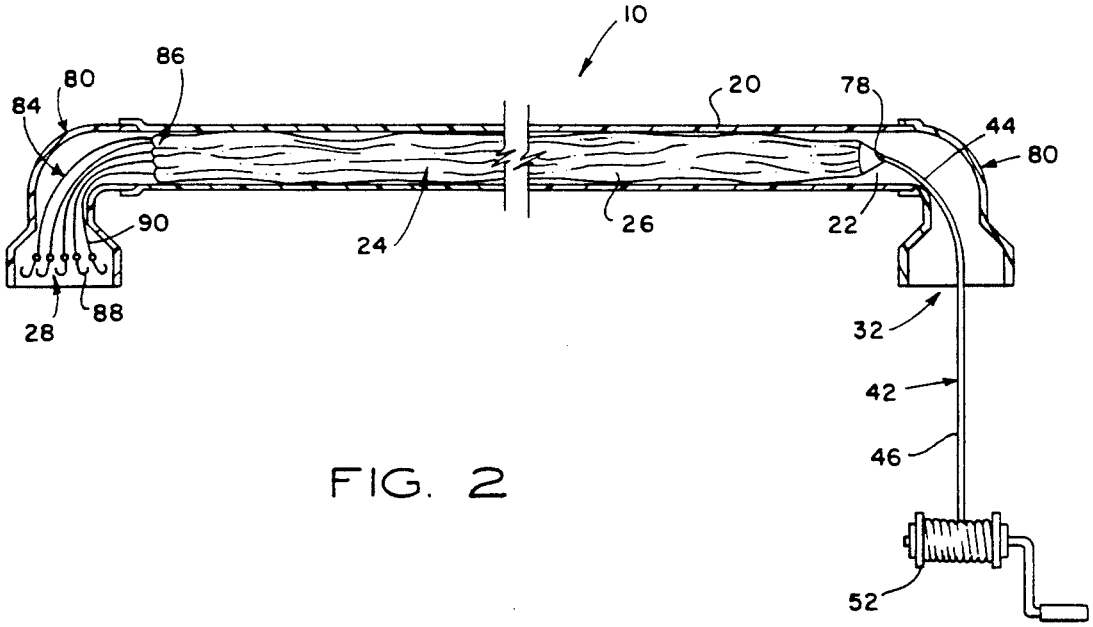
FIG. 2 is a cross-sectional view of the storage tube showing the deployable protective covering in the stowed position.
Figure 1:
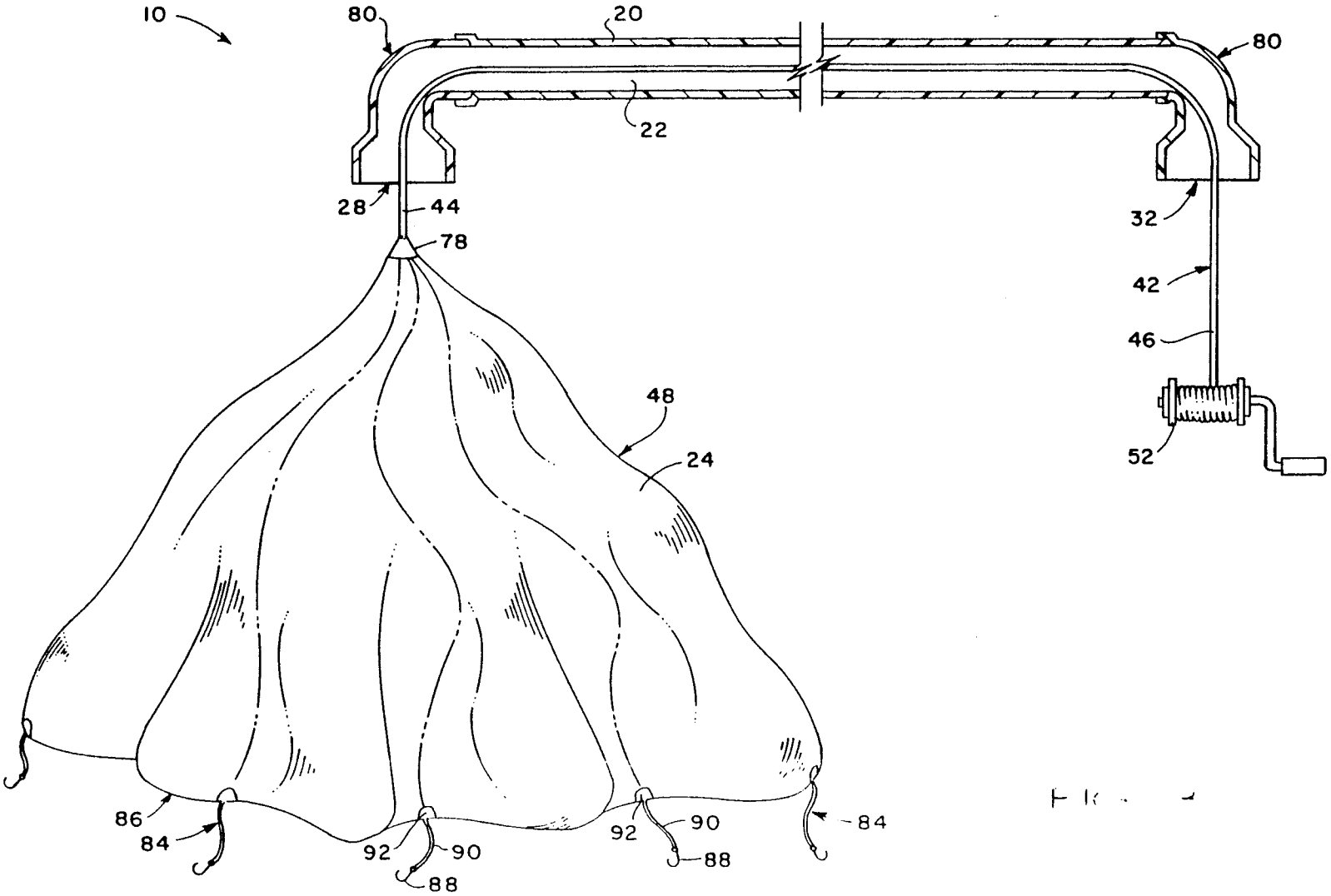

FIG. 3 depicts the deployment or dispensing of the protective sheet from its stowed position 26 (FIG. 2). In the deployed position 48, the support line 42 first extends from its attachment point 78 to the protective sheet 24 through the open end 28 of the storage container 20 and then through the inner chamber 22. Sufficient length of the second end 46 should be left to permit the second end 46 of the support line 42 to remain attached to the winch 52 or to be gripped by the operator when the protective cover 24 is to be returned to its stowed position 26. If a winch 56 is not used, the second end 46 of the support line 42 can be held in place by wrapping the line about a cable tie down.

As a matter of choice, the first and second ends 28, 32 of the storage container 20 may be formed having or including elbows or L shaped turns 80. With the elbow 80, it is preferable that the opening of the storage tube ends be directed downwards, that is, generally toward the object to be protected. The downward orientation of the opening helps in the deployment or dispensing of the sheet 24 from the storage tube 20. Second, the downward pointed opening reduces the likelihood of rain or other unwanted debris entering the inner chamber 22 of the storage tube. Finally, the downward orientation of the opening provides easier access for the operator who is standing on the ground 82 below the opening to reach into the tube and to grasp the protective cover 24.

Figure 5:
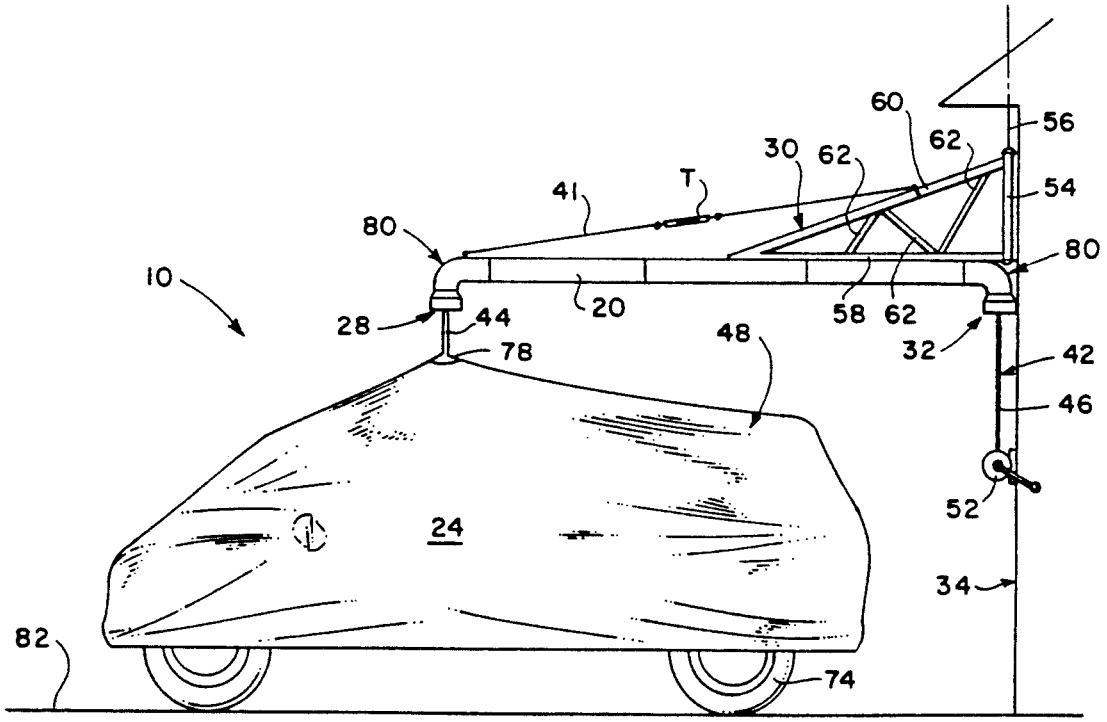
FIG. 5 is a side view of the components shown in FIG. 1 showing the protective covering shielding a vehicle.

The protective cover or sheet 24 is well known in the art and typically is a tarpaulin, a plastic sheet, Nylon fabric or some other type of water resistant, flexible material suitable for folding and stowing in the storage tube. The protective cover 24 may be specifically formed or shaped to follow the outline of the specific object to be protected as shown in FIG. 4 where the protected object is a boat 76, or as shown in FIG. 5 where the protected object is a car 74.

Preferably, anchoring means 84 are mounted about the periphery 86 of the protective sheet 24 to secure the protective sheet 24 about the object to be protected. Typically, such anchoring means 84 include a J-shaped hook 88 and a cord 90, such as a bungee or rubber line, extending between the hook 88 and a point of attachment 92 to the protective sheet 24.

The operator first positions the object to be protected beneath the swing arc of the open end 28 of the storage tube 20. FIG. 4 depicts a typical boat 76 on a towing trailer 94 resting on a surface on the ground 82 in front of the main doors 50 to the garage. Similarly, in FIG. 5, a car 74 or other vehicle is shown resting on surface 82 adjacent a building or other structure S.

The storage tube 20 is preferably mounted close to the building corner 34 to prevent the storage tube 20 from blocking the entrance area of the structure S. FIG. 1 depicts the storage tube 20 in such a position with the storage tube 20 having been swung in an arc about the pivotal axis 56 of the pivot joint 54 so that the tube 20 lies alongside the garage wall 36 thereby conserving space. Once the object to be protected is properly positioned, the operator swings the storage tube 20 about the pivotal axis 56 of the pivot joint 54 in the attachment member 30 to a position where the open end 28 of the storage tube 20 is above the object to be protected. The operator then releases the winch 52 and deploys the protective cover 24 from its stowed position 26 in the storage tube 20 (FIG. 2) to its covering position 48 about the object to be protected. The anchoring means 84 would then be secured, as desired, to the boat 76 or car 74 that is being protected.

Optionally, the supporting cable 42 may be placed under tension using the winch 52 or other means to firmly attach the anchoring means 84 to the vehicle and to help secure the protective sheet 24 about the object to be protected from being blown off or removed from the vehicle. Additionally, known security or padlocks (not shown) may be used being secured through grommets or eyes in the protective cover 24 to lock the protective cover 24 about the vehicle or boat.

When the operator is ready to use the boat 76 or vehicle 74, generally the procedure is reversed to return the protective cover 24 to its stowed position 26. The operator first releases any tension on the protective sheet 24 and then detaches the anchoring means 84 and lock from the vehicle or boat. Once the protective sheet 24 is loose, the operator then pulls on the second end 46 of the retraction line 42. The pulling of the cable 42 draws the protective sheet 24 into the inner chamber 22 through the open end 28. The open end 28 guides the protective sheet 24 into its stowed position 26. Once the protective sheet 24 and anchoring means 84 are fully withdrawn into the storage tube 20, the support cable 42 is secured and the winch is locked. The storage tube 20 with the stowed protective sheet 24 is then swung back to its storage position next to the garage wall 36 (FIG. 1).

Figure 7:
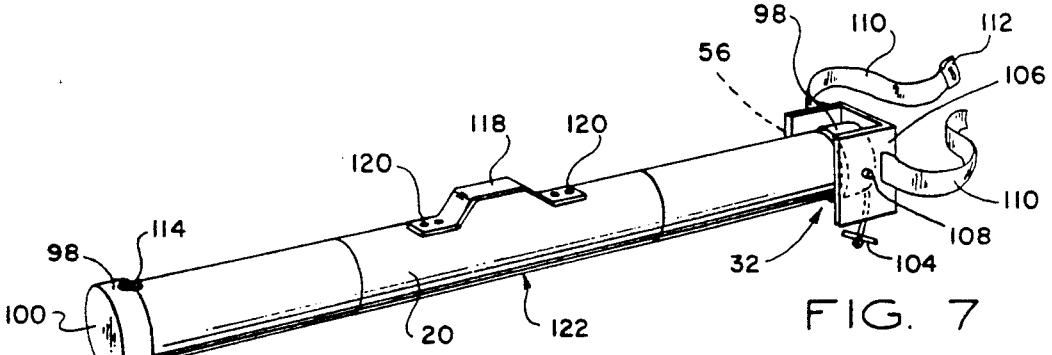
FIG. 7 is perspective view of the portable storage tube of FIG. 6.
Figure 8:
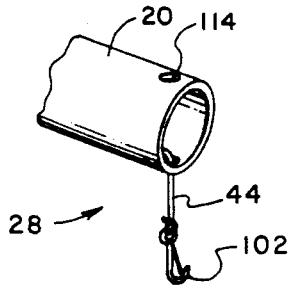
FIG. 8 is a perspective view of the deployment end of the portable storage tube embodiment.

Referring now to FIGS. 6–8, a portable embodiment of the present invention is directed toward a portable storage tube 20 for storing a protective cover 24, tent shelter or hunting blind 96 or the like. The elongated storage container 20 of the portable embodiment similarly is a tube having a hollow bore 22 as shown in FIG. 1.

The open support end 32 of the storage tube 20 has a removable cap 98 for sealing the storage tube 20 from water and insects. The deployment end 28 of the storage tube 20 is closed by a removable cap 100. A swivel 102 is attached to the deployment end 44 of the support line for suspending the hunting blind 96 in an erect configuration as shown in FIG. 6. A handle 104 is further secured to the second end 46 of the support line 42 to assist the operator in erecting the hunting blind.

The attachment member 30 of the portable embodiment is modified to be removable from the supporting base 34. A U-shaped bracket 106 is mounted with the second end 32 of the storage tube 20. Optionally, a pivot pin 108 extends between the arms of the U-shaped bracket 106 to pivotally mount the U-shaped bracket 106 to the storage tube 20.

Typically, the pivot axis 56 about which the storage tube 20 swings in the portable embodiment is approximately perpendicular to the pivot axis 56 of the fixed attachment embodiment when mounted. Comparing the swing of the fixed mounted storage tube 20 first in FIGS. 1 and 4 with the swing of the portable storage tube 20 as shown in FIG. 6, the pivot axis 56 of the fixed attachment embodiment is typically perpendicular to the ground or supporting surface 82 of the vehicle or, in other words, generally parallel to the support base 34; whereas, the pivot axis 56 of the portable embodiment is essentially parallel to the ground or the supporting surface 82 to allow the first end 28 of the storage container 20 to swing from a position close to the ground 82 to a horizontal position.

The U-shaped bracket 106 and storage tube 20 is mounted to the supporting base 32, such as a tree 40 or pole 38, by means of a pair of straps 110 or a single strap 110 extending through the U-shaped bracket 106 and having strap joining means 112, such as a buckle. The arms or free segments of the strap 110 are wrapped around the supporting tree 40 and attached together to firmly mount the second end 32 of the storage tube 20 to the tree 40.

It is preferred to have a secondary attachment member 64 extending from an attachment point 68 near the first end of the storage tube 20 to a position 70 on the supporting base 34 above the main attachment means 30. Such secondary attachment or supporting member 64 in FIG. 6 includes: (a) an attachment eye 114 affixed to a position 68 near the first end of the storage tube, and (b) a cable or line 66 extending from the eyelet opening 114 and wrapped around the tree 40 above the securing strap 110 of the main attachment member 30.

A handle 118 is optionally mounted on the exterior of the support tube 20 assists in the carrying and portability of the portable embodiment. Preferably, the handle 118 is a strap affixed to the tube by means of rivets 120, screws or the like, and is mounted near the center of balance 122 for the storage tube.

The protective covering 24 shown in FIG. 6 is in the form of a tent shelter which is typically used as a hunting blind. Such a protective covering 24 has four sidewall panels 124 and a roof panel 126. Apertures or windows 128 are formed in one or more of the sidewall panels 124 to permit ventilation and observation. Stakes 130 fix the bottom of the hunting blind 96 to the ground surface 82.

The general operation of the portable embodiment is essentially similar to the operation of the fixed attachment embodiment described above. First, the operator would select the location for mounting of the portable storage container 20. The main attachment means 30 would be mounted about the tree 40 by wrapping the strap 110 around the tree 40 and affixing the buckle 112. The main attachment 30 should be positioned at the desired or selected height based on the chosen type of protective cover 24. The storage tube 20 would then be swung into position paralleling the ground or supporting surface 82 and the secondary supporting line 66 would be extended from the attachment eye 114 to the tree at a position above the main attachment strap 30. The end cap 98 would then be removed from the storage tube and the protective cover 24 would be deployed from its stowed position.

Storage of the protective cover 24 is accomplished by first removing the ground stakes 130. The handle 104 attached to the second end 46 of the supporting cable 42 would be pulled to draw the protective cover 24 into the inner bore 22 of the storage tube 20. The removable end cap 98 would then be reattached to the first open end 28 of the tube 20. The storage tube 20 would then be detached from the tree 40 by first removing the cable 66 and finally the main attachment strap 110.

Figure 9:
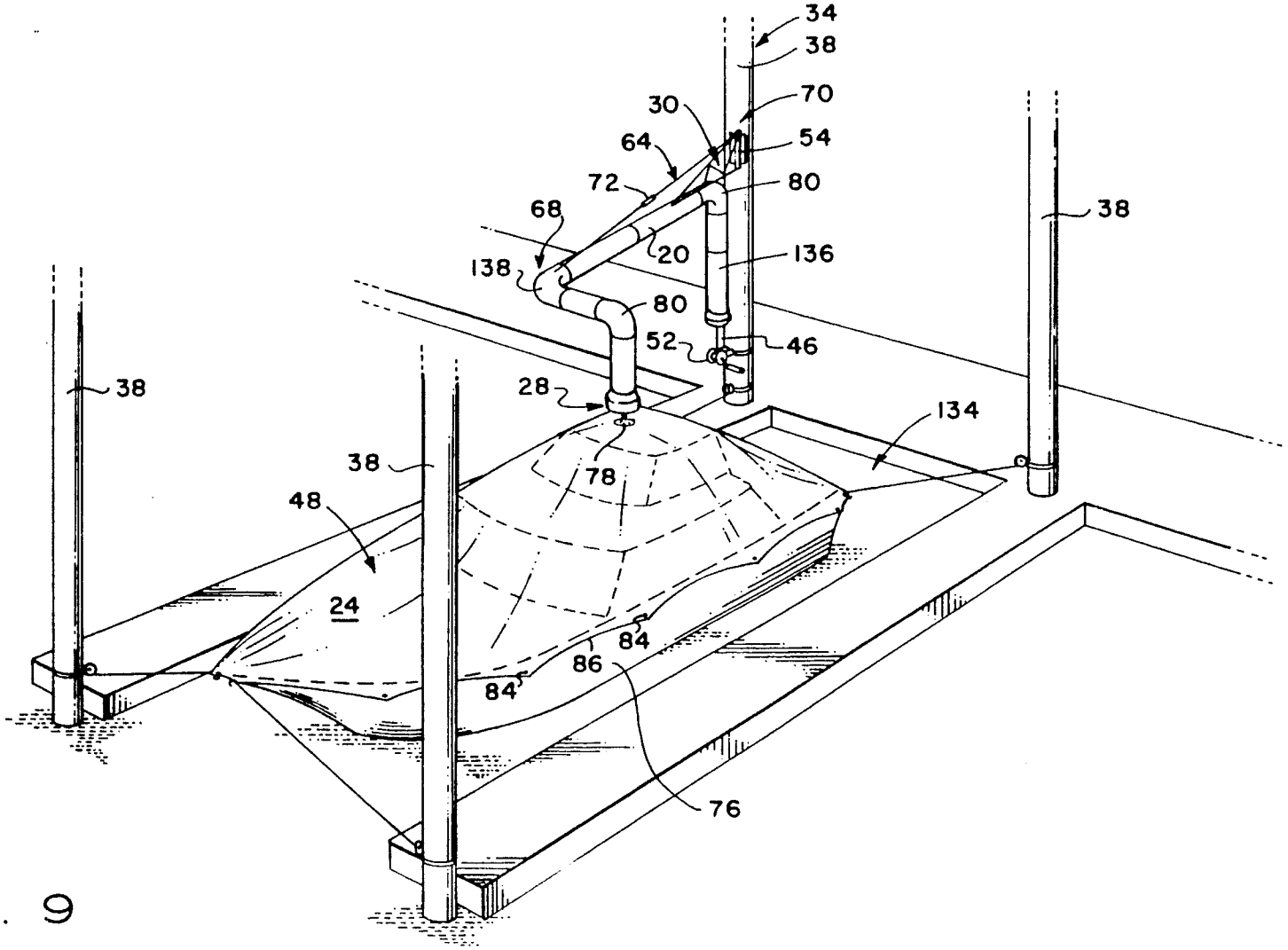
FIG. 9 is a perspective view of the covering system being used to protect a boat stored in a boat landing.

Referring now to FIG. 9, the storage container 20 of the present invention is further adapted for the protection of a boat 76 positioned within a boat landing slip 134. Typically, the storage container 20 is secured to a pole 38 or beam near the boat landing slip 134. The second end 32 of the storage container 20 has an elbow 80 with an extended arm 136. An intermediate elbow 138 may be formed in the storage container 20 to further position the first open end 28 in a position closer to the center of the slip 134 without blocking access to the slip 134.

The boat landing slip embodiment shown in FIG. 9 includes a secondary attachment or supporting means 64. The storage tube 20 is additionally held in the desired orientation with a cable 66 and turnbuckle 72 extending from a point 68 intermediate to the first and second ends of the storage container to a point 70 above the point of attachment 30 of the main attachment means to the pole 38 or to a high point on the main attachment means 30 itself.

As was also described above, a retraction line 46 is attached to a motorized or manual winch 52 and supports the protective cover 24. The protective cover is typically a tarpaulin with anchor members 84 secured about its periphery 86 for attachment to the boat 76.

The operation of the boat landing slip embodiment is similar in all respects to the operation of the fixed attachment embodiment described above.

Figure 10:
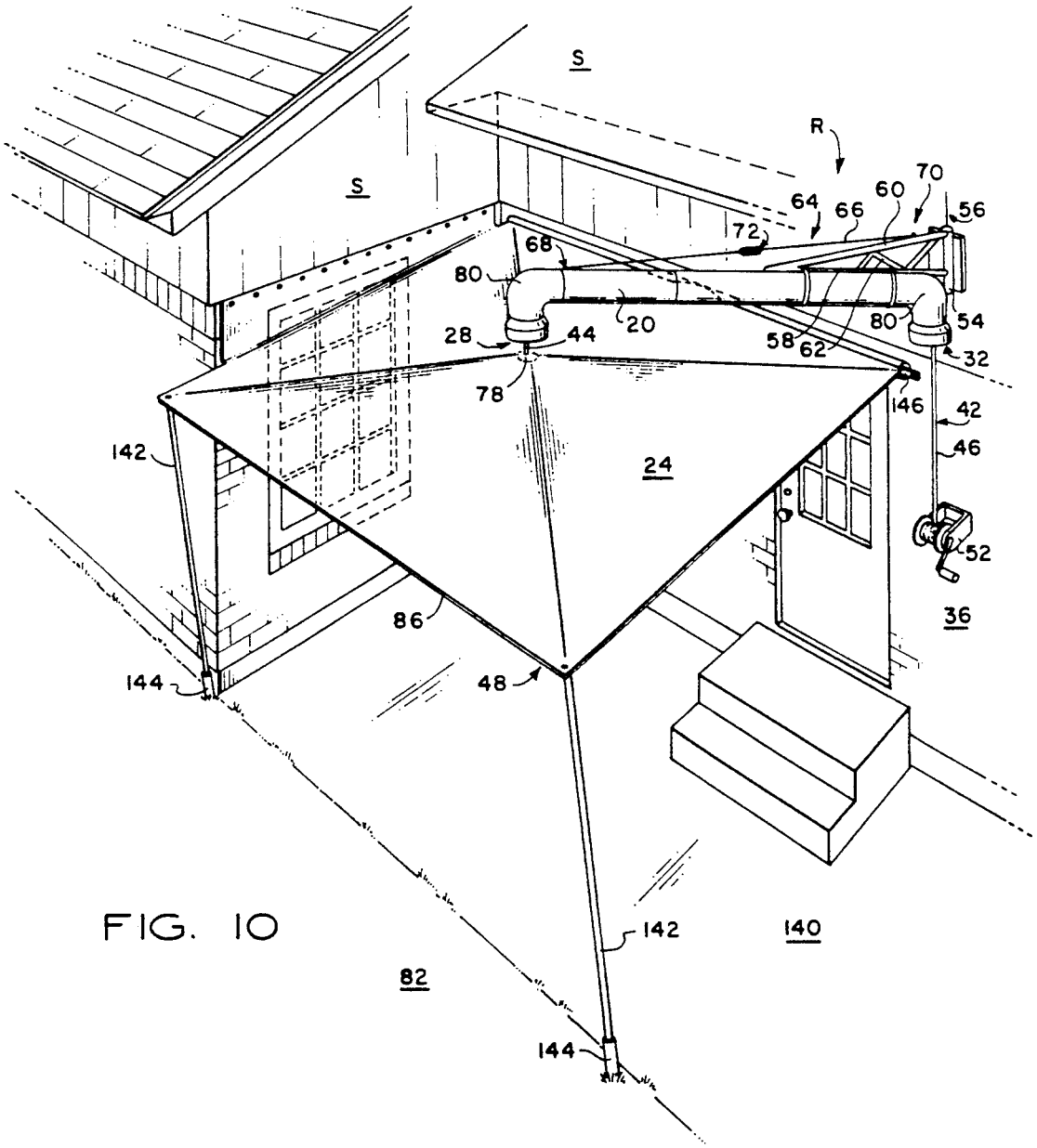
FIG. 10 is a perspective view of a patio covering embodiment of the present invention mounted to a house and showing a support frame for the protective cover.

Referring now to FIG. 10, a patio cover embodiment of the present invention is shown including a protective cover 24 for a patio 140 with upright frame members 142 for supporting and stretching the cover 24 in the desired form.

The storage container 20, attachment means 30, and securing cable 42 are substantially similar in design and operation to their corresponding elements in the fixed attachment embodiment. The protective cover 24 in the patio cover embodiment, however, is generally in a square or rectangular shape having upright frame members 142 attached to selected corners to form or stretch the protective cover 24 into a protective canopy above the patio 140.

The frame members are poles 142 extending between corners of the protective cover 24 to the ground 82. The frame members 142 may be held in place by positioning ends of the poles 142 within tubes 144 anchored in the ground 82. A horizontal frame member 146 may be attached to a sidewall 36 of a house or other buildings for anchoring and stretching one side of the protective cover 24 to the buildings.

The deployment of the patio cover embodiment of the present invention is essentially the same as described above with reference to the fixed attachment embodiment.

Since changes could be made in the above construction and different embodiments of this invention could be made without departing from the scope thereof, it is intended that all matter contained in the drawings and specification shall be interpreted as illustrative and not in a limiting sense.

What is claimed is:

1. A covering system for protecting an object comprising:

a flexible protective sheet of a desired size for covering an object;

an elongated storage container having an inner chamber for receiving said sheet in a collapsed state and an open end through which said sheet may be deployed from said chamber;

attachment means mounted on a second end of said storage container for attaching said storage container to a supporting structure; and retraction means including a flexible line connected to said sheet for withdrawing said sheet from a deployed position into said inner chamber of said storage container for storage, said line having a first end attached to said sheet and having a second end for pulling the sheet from the deployed state into said inner chamber of the storage container, said line extending through said inner chamber of the storage container when said sheet is deployed from the storage container.

2. A covering system as defined in claim 1, wherein said attachment means includes a hinge for supporting movement of the storage container about a pivotal axis.

3. The covering system as defined in claim 1, wherein said open end of said storage container has an L shaped with the opening to the storage compartment being directed transversely with respect to the storage container.

4. The covering system as defined in claim 1, including a winch coupled to said line for drawing said sheet into the inner chamber of the storage container.

5. In combination with a cover assembly of the type having a flexible protective sheet for an object to be protected and a supporting line attached to the cover, the improvement which comprises;

an elongated storage container having an inner chamber for receiving the sheet in a collapsed state and an open end through which the sheet is received into said chamber;

attachment means mounted on a second end of said storage container for attaching said storage container to a support structure; and, said supporting line having a first end attached to the sheet and a second end for pulling the sheet from the deployed state into the inner chamber of the storage container, said supporting line extending through said inner chamber of the storage container when the sheet is in the deployed state.

6. A protective covering assembly as defined in claim 12, wherein said storage container comprises multiple tubes assembled end to end.

7. A deployable protective covering system for shielding an object comprising:

a flexible protective sheet of a desired size for protecting an object;

an elongated storage housing having a chamber for receiving said sheet in a collapsed state and a first open end through which said sheet is received into said cavity and having a second open end opposite said first open end;

said first open end of said storage housing being formed in an L shaped with the opening to said chamber being directed essentially toward the object to be protected;

a support line connected to said sheet for pulling said sheet from a deployed position into said chamber for storage;

said support line having a first end attached to said sheet and a second end extending through said second open end; and attachment means secured to said storage housing for attaching said storage housing to a support structure at an elevation above the object to be protected.

8. A deployable protective covering system of claim 7, wherein said attachment means further includes a hinge for supporting swinging movement of said storage housing from a storage position to a deployment position.

9. A deployable protective covering system as defined in claim 7, wherein the object to be protected is a vehicle.

10. A deployable protective covering system as defined in claim 7, wherein the object to be protected is a boat.

11. A deployable protective covering system as defined in claim 7, further including a winch coupled to said support line for pulling the sheet into the receiving chamber of the storage container.

12. A deployable protective covering system of claim 7, wherein said protective sheet is a tarpaulin.

13. A deployable protective covering system of claim 7, wherein said support structure is a garage.

14. A deployable protective covering system of claim 7, including sheet supporting means adapted for ground installation for supporting said sheet in a desired deployed form.

15. A deployable protective covering system for shielding an object comprising:

a flexible protective sheet for covering an object;

an elongated storage tube having a bore for receiving said sheet in a collapsed state and a first open end through which said sheet is received into said bore and a second open end opposite said first open end;

a support line connected to said sheet for withdrawing said sheet from a deployed position into said bore of said storage tube for storage;

said support line having a first end attached to said sheet and a second end for pulling the sheet from the deployed state into said bore of the storage tube, and said support line extending through said bore when said sheet is in the deployed state; and, movable attachment means mounted to the second open end of the storage tube for attaching said storage tube to a support structure.

16. A deployable protective covering system as defined in claim 15, wherein the object to be protected is a vehicle.

17. A deployable protective covering system as defined in claim 15, wherein the object to be protected is a boat.

18. A deployable protective covering system as defined in claim 15, including:

an elbow formed in said storage tube on said first open end with the opening to the bore being directioned essentially toward an object to be protected.

19. A deployable protective covering system of claim 15, wherein said storage tube comprises a length of plastic pipe.

20. A portable covering system comprising:

a collapsible covering;

a storage tube having an inner chamber for receiving said collapsible housing in a collapsed state and an open end through which said collapsible covering may be deployed and retracted;

attachment means mounted on the storage tube for removably attaching said storage tube to a support base; and, a retraction line connected to said collapsible covering for withdrawing said collapsible housing from a deployed position into said inner chamber of said storage tube.

21. A portable covering system as defined in claim 20, including:

secondary tube supporting means extending from the storage tube for removably attaching said storage tube to said support base; and a removable end cap for substantially sealing the open end of the storage tube;

whereby the portable storage tube provides protective storage for the collapsible covering when the covering is not being used and controllably dispenses the covering, and aids in the support of the covering when installed on a support base.

22. A portable covering system of claim 20, including a frame for maintaining a desired shaped of the collapsible covering in the deployed position.

23. A portable covering system as defined in claim 20, wherein said collapsible covering further includes apertures for viewing.

24. A portable covering system as defined in claim 20, wherein said supporting base is a tree.

25. A portable covering system as defined in claim 20, wherein said retraction line has a first end attached to said collapsible covering and has a second end for pulling the collapsible covering from the deployed state into the inner chamber of said storage tube, and said retraction line extending through the inner chamber of the storage tube when said collapsible housing is in the deployed state.

* * * * *